US006843196B1

(12) United States Patent
Richardson et al.

(10) Patent No.: US 6,843,196 B1
(45) Date of Patent: Jan. 18, 2005

(54) ANCHOR ASSIST

(76) Inventors: Kenny Carl Richardson, 10625 SE. 362nd, Space D11, Boring, OR (US) 97009; Larry Donn Richardson, 3070 SE. 21st St., Gresham, OR (US) 97080-6208

( * ) Notice: Subject to any disclaimer, the term of this patent is extended or adjusted under 35 U.S.C. 154(b) by 0 days.

(21) Appl. No.: 10/603,333

(22) Filed: Jun. 26, 2003

(51) Int. Cl.[7] ..... B63B 21/22
(52) U.S. Cl. ..... 114/210
(58) Field of Search ..... 114/210, 215, 114/218, 381

(56) References Cited

U.S. PATENT DOCUMENTS 3,554,153 A * 1/1971 Davis ..... 114/210
3,704,680 A * 12/1972 Uher ..... 114/210
3,865,065 A * 2/1975 Dennis et al. ..... 114/210
3,952,683 A * 4/1976 Eudy et al. ..... 114/210
4,057,025 A * 11/1977 Piotrowski ..... 114/210
4,248,171 A * 2/1981 Barbour ..... 114/210
4,362,119 A * 12/1982 Thimander ..... 114/210
5,996,524 A * 12/1999 Johnson ..... 114/210

* cited by examiner

*Primary Examiner*—Lars A. Olson
(74) *Attorney, Agent, or Firm*—Chernoff Vilhauer McLung & Stenzel, LLP

(57) ABSTRACT

The An anchor retrieval assist device including a "U" shaped type of boat bow chock-rope guide and anchor staging and storage device which allows buoy type anchor retrieval devices to be pulled through the guide without rope removal. It is designed to allow pulling of an anchor via the buoy retrieval system with a rope routed through the device and attached to a forward cleat on a boat. The anchor can be easily released from its storage-rest position by raising the anchor rope, tipping the anchor to allow it to roll off the bow rest position into the water. A pin is provided to secure the anchor in the rest position. The device works equally well with or without mechanical buoy type retrievers for anchoring and retrieving the anchor manually.

15 Claims, 16 Drawing Sheets

ANCHOR ASSIST

BACKGROUND AND SUMMARY OF THE INVENTION

The anchor assist device was designed and created for boat anchoring to fill a void in the market for boat anchoring and retrieval of anchor systems utilizing mechanically designed anchor float retrieval systems. Other pullers require removing the rope from the anchor chock and pulling the buoy, retrieving mechanism, lead chain (when used) and anchor up and over the side of the bow, often damaging the gunnel or sides of the boat.

In this device, the anchor puller and buoy are able to be pulled through the wider roller and guide system without removal from the rope guide. The primary design difference, not previously available, is the use of a metal step roller bracket which is designed to have a wide enough throat space to accommodate the various buoy puller mechanisms (such as, but not limited to EZ Marine lifter, Ironwood Pacific puller, and other types) with vertical guides to keep the rope in the device while the puller transitions through it and buoy transitions over it.

The anchor assist device is a wider and higher type of "U" shaped type of boat bow chock-rope guide and anchor staging and storage device which allows buoy type anchor retrieval devices to be pulled through the guide without rope removal. It is designed to allow pulling of the anchor via the buoy retrieval system with the rope routed through the device and attached to the bow or other forward cleat point. It is designed to allow the resting anchor to be easily released from its storage-rest position by raising the anchor rope. This tipping of the anchor allows it to release and roll off the bow rest position into the water. The "U" shaped rest, formed by a frame, gusset platform, rollers and guides, provides a sure rope guide and a secure platform for anchor retrieval and storage. A pin device is used to secure the anchor in the rest position during transition or travel. The anchor lies on the device in the rest position, ready to release without the pin device installed. The anchor is in position for the next release when brought to rest in the anchor assist device. The device works equally well without mechanical buoy type retrievers for anchoring and retrieving the anchor manually.

A tapered center roller guide (of UHMW polyethylene or similar material), of large enough diameter allows the transition from rope end, past the lifter hardware and on to the anchor chain (when used) and directly to the anchor, so that the anchor settles to rest in the bracket on the gusset platform and center roller guides in the bracket. A rope groove is cut in the center of the center roller guide to help provide a positive center line position for the rope while at anchor.

Outside vertical right and left side guides fashioned from the same material as the center roller guide (UHMW polyethylene) provide a smooth protective surface for the rope to ride against when under power of retrieval and keep the rope from contacting the outer extremities of the metal mount or rest roller framework. These guides may be either of two types, depending on the version selected. The regular version is non-rolling. The deluxe version is a rolling design and revolves when rope contact is made on these side rollers instead of the primary front roller.

On each side of the front exterior retaining surfaces of the framework are horizontal cylindrical guides to retain the rope within the roller (chock) retaining area of the anchor assist device both during regular anchoring operations and during anchor retrieval operations.

The framework can be of two design variations. One is a two-piece construction. The mounting bracket is formed from of a single piece of metal cut in a flat sheet for shapes and holes then bent into a "U" shape. A single gusset plate is then fitted and welded in place to provide rigidity and serve as an anchor rest platform in the device.

The other method, providing nearly identical results is, to construct the framework of four flat pieces, two mirror images of the upright pieces and the bottom and gusset plates. The four pieces are then welded together resulting in a nearly identical product, with the same applications as discussed above.

The design helps reduce the chance that an anchor being retrieved would swing and hit the sides of the boat as the anchor is pulled. The anchor assist device keeps the anchor away from the sides and gunnel as it comes into the rest position.

The anchor assist device provides a ready position for the anchor to rest prior to releasing it for anchoring. A securing mechanism is designed into the frame that allows it to be securely fixed in place for movement from an anchor site to another anchor site or for travel via water or boat trailer.

The anchor assist device also provides a cantilever position for the anchor to rest in its ready position on the bow. This design allows for a single person to release and drop the anchor with a lift of the rope from nearly any clear portion of a boat, i.e., near or at the steering wheel or the walk through bow window of many boat designs. This is of significant importance to persons such as guides and charter captains who might be responsible for all boat anchoring activities alone or for those boat owners/operators who cannot or do not want to rely upon others to anchor for them.

The anchor assist device provides a solid leverage and large rope guiding surface to allow use of the anchor retrieval systems from a bow attachment point. This is a significant safety factor for anchor retrieval in heavy current or rough water situations. When the pulled anchor is ready for retrieval, the rope is simply pulled through the anchor assist device until the anchor comes to rest in the device.

The device works equally well without mechanical buoy type retrievers for anchoring and retrieving the anchor manually.

DETAILED DESCRIPTION OF THE PREFERRED EMBODIMENTS

Figure 1:
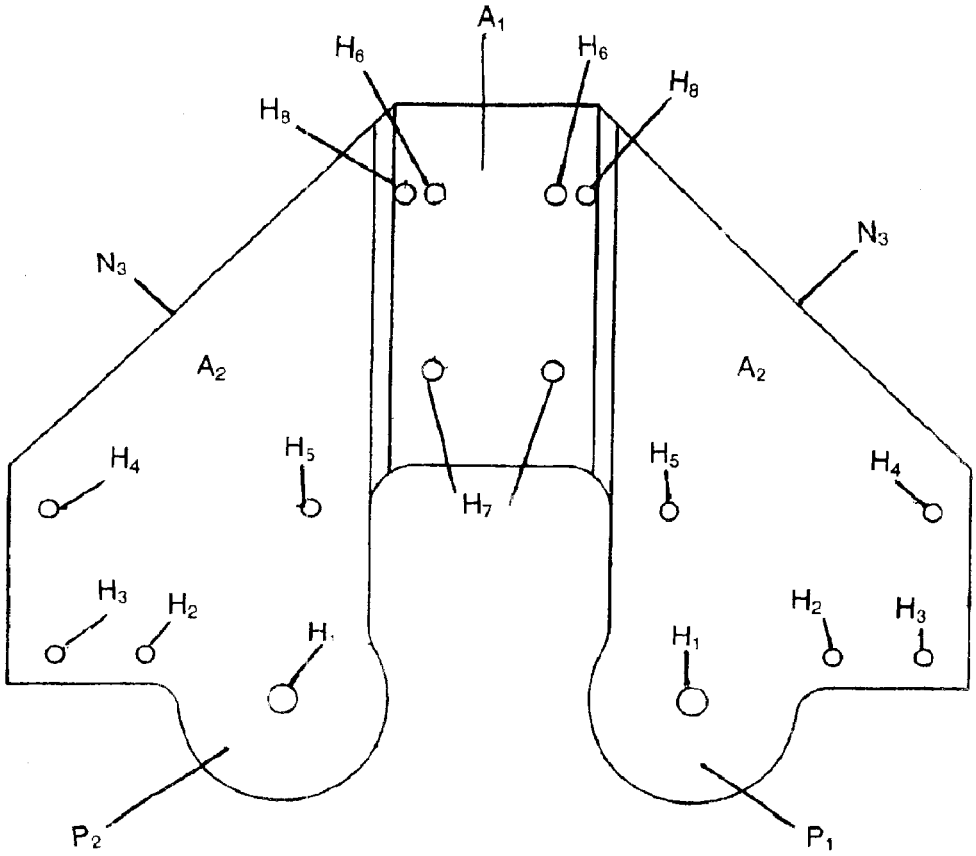
FIG. 1 is a flat pattern layout of the "U" shaped bracket for an anchor assist device embodying the invention.
Figure 2:
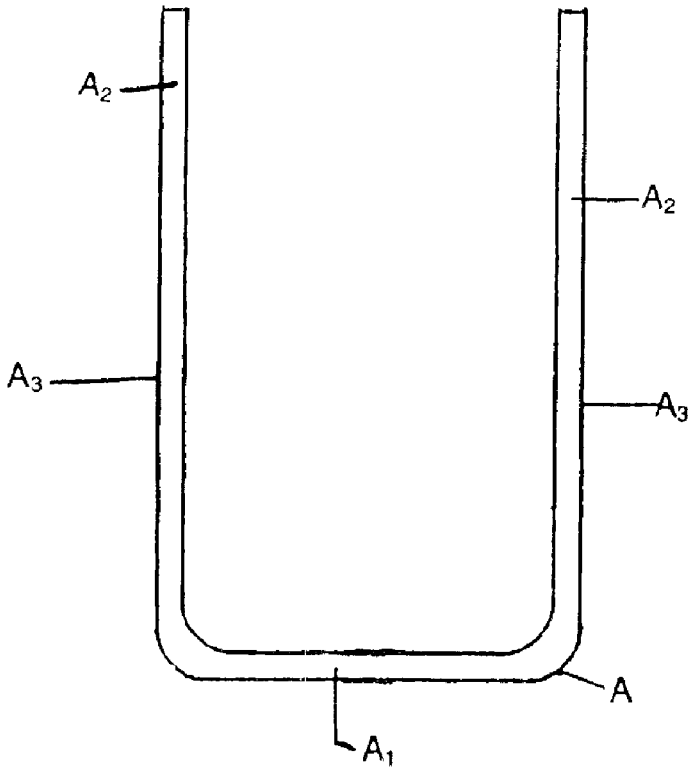
FIG. 2 is a rear view of the bracket shown in FIG. 1 after being formed by the fabricator but in the "U" shaped configuration prior to the addition of the welded gusset plate.

A "U" shaped bracket shown in FIGS. 1 and 2 includes the base $A_1$ and two sides $A_2$ of the anchor device AA. A gusset plate B is welded in place between the two sides $A_2$ forming an anchor rest platform, and can be adjusted to fit a milled countersink to improve consistency in placement. A tapered center roller $D_1$ is installed at the front $D_2$ of the anchor assist device AA, between two sides $A_2$. The center roller $D_1$ may be formed of ultra high molecular weight (UHMW) polyethylene and is 3½ inches in diameter. Horizontal roller guides $E_1$ and $E_2$ are interchangeably affixed to either side $A_2$ and are also formed of 3½ inch diameter UHMW polyethylene. Outer vertical guides $F_1$ and $F_2$ are also interchangeably affixed to either side $A_2$ and are formed of 1½ inch diameter UHMW polyethylene with a 3½ inch height. The vertical guides $F_1$ and $F_2$ are affixed to the sides $A_2$ by screws $G_1$ and $G_2$, which may be ¼ inch diameter, threaded stainless steel countersunk or Phillips pan head screws with ¼ inch locknuts. Each side $A_2$ has a through-hole $H_1$ to define the attachment location of the center roller $D_1$ and the horizontal roller guides $E_1$ or $E_2$ respectively. Each side $A_2$ also has a bottom hole $H_2$ and a top hole $H_3$ to receive the screws $G_1$ and $G_2$ for attachment of vertical guides $F_1$ and $F_2$, respectively. Each side $A_2$ also has a carriage pin hole $H_4$ defining a location for a cotter-less carriage pin U, which in one embodiment is a 5/16 inch diameter×4½ inch long pin, to secure an anchor in the anchor assist device AA. Each side $A_2$ also has a bottom storage hole $H_5$ for holding the carriage pin U when it is not being used to hold an anchor.

The tapered center roller $D_1$ and the horizontal roller guides $E_1$ and $E_2$ are mounted on and capable of rotation around a ½ inch diameter, 7 inch long hex head stainless steel bolt I, which extends through each ½ inch hole $H_1$, through a centrally drilled spindle hole M in each horizontal roller guide $E_1$ and $E_2$ and in the center roller $D_1$.

A 1 inch outside diameter, ½ inch hole stainless steel washer J and a ½ inch stainless steel lock nut K (of Teflon insert or similar type) secure bolt I in place in the bracket A, together with center roller $D_1$ and the horizontal roller guides $E_1$ and $E_2$. Each of the horizontal roller guides $E_1$ and $E_2$ has a 1½ inch diameter by ½ inch deep countersunk hole $L_1$ and $L_2$, drilled in concentric alignment with center roller $D_1$ and spindle holes M.

Each side $A_2$ has a top side $N_1$ and bottom side $N_2$ which are parallel when the device is installed to a boat gunnel. Each side $A_2$ has a sloped margin $N_3$ which extends from the top $N_1$ to the bottom $N_2$ at a 45 degree angle. Each side $A_2$ has 1¾ inch radius bottom front roller support regions $P_1$ and $P_2$ respectively, which support horizontal roller guides $E_1$ and $E_2$ respectively.

There are at least two possible embodiments of bracket A. In one embodiment of the bracket A, the the base plate $A_1$ and the two sides $A_2$ are formed from a single sheet bent at right angles. In an alternative embodiment of the bracket A, the base plate $A_1$ and the sides $A_2$ are cut separately and welded together.

Figure 10:
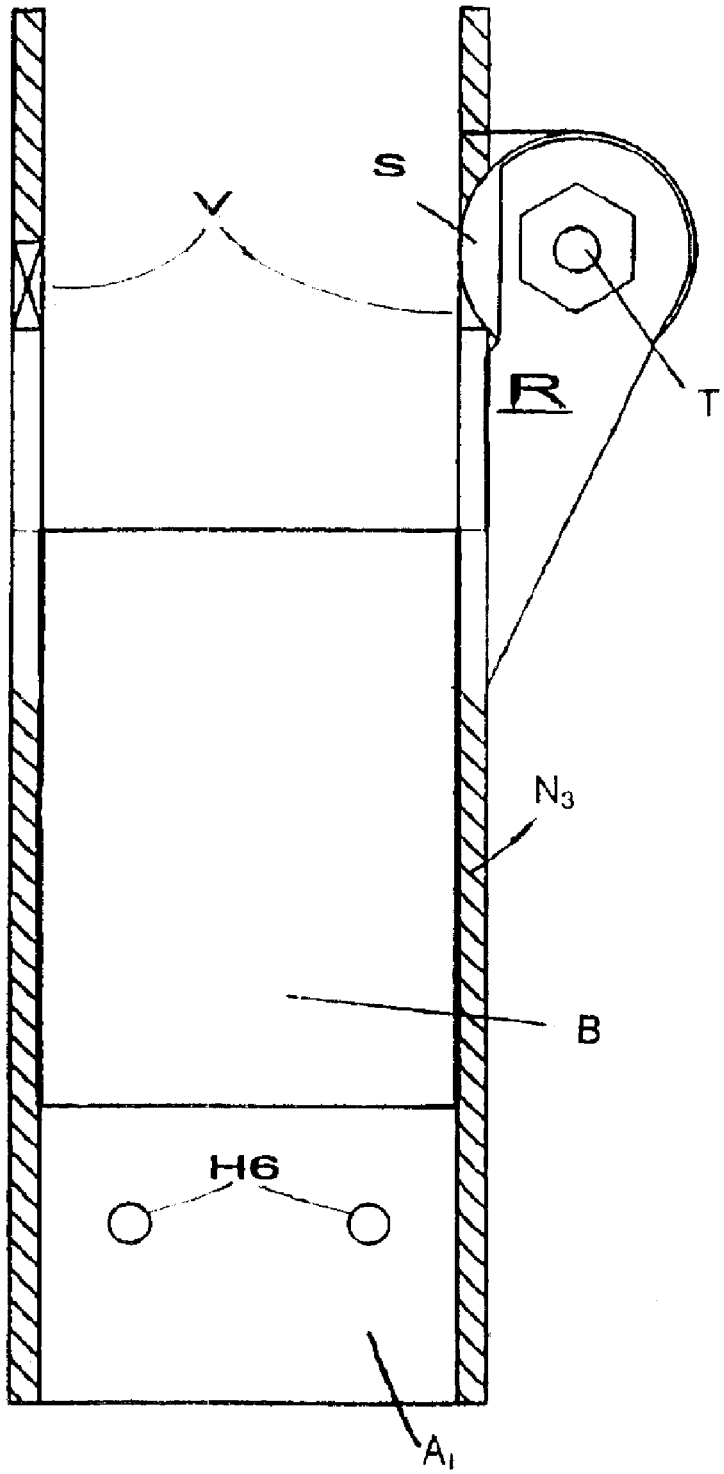
FIG. 10 is a top plan view of a portion of an anchor assist device that is an alternative embodiment, showing a vertical guide roller on one side and a modified bracket that is required for the vertical guide roller, but omitting the vertical guide roller and modified bracket from the opposite side.

The anchor assist device AA may alternatively include a front upper vertical roller guide S, shown in FIG. 10. Election to include the upper vertical roller guide S necessitates that bracket A should include support R. As shown, front upper vertical roller guide S has a 2 inch diameter and 2¼ inch length and defines a center hole Y ⅜ inch in diameter extending through it longitudinally. Roller spindle T extends through the hole Y in the upper vertical roller guide S and may be a ⅜ inch diameter stainless steel hex head bolt. The roller spindle T secures the upper vertical roller guide S to support R at a ⅜" threaded hole X.

To accommodate the upper vertical roller guide S as shown in FIG. 10, the bracket A has to provide room and thus is smaller by an area that can be called a cut out V at each side $A_2$. The size reduction or cut out V, indicated in broken line in FIG. 11, measures ¾"×2⅞".

The anchor assist device AA is mounted on a user's boat by fasteners $H_6$ and $H_7$, such as 5/16×1 inch, 24 thread stainless steel hex head bolts or pan head Philips screws with washers and lock nuts. Said assemblies $H_6$ and $H_7$ should be as far forward on a bow deck Q as possible while retaining full contact between the base $A_1$ and the bow deck Q. The intended placement of the front $D_2$ is designed to extend the center roller $D_1$ beyond the bow Q.

Figure 3:
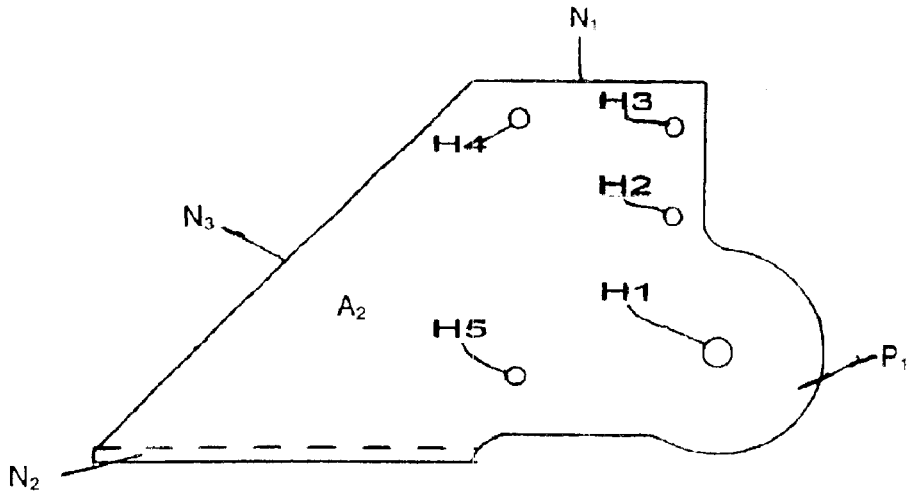
FIG. 3 is a side view of the bracket shown in FIG. 2.

In one exemplary embodiment, of the anchor assist device AA, the bracket A is laid out on ¼ (0.25) inch 5052 aluminum (or equivalent alternative) according to FIG. 1. Holes $H_1$, $H_2$, $H_3$, $H_4$, and $H_5$ are punched or drilled as shown in FIG. 1 and FIG. 3. The outside perimeter lines of bracket A are preferably cut by computer-assisted plasma cutter or laser, or by means of a manually operated bandsaw. Bracket A so cut from the single piece flat pattern design as shown in FIG. 1 is intended to be bent by a press into a "U" shaped bracket A including base $A_1$ and two sides $A_2$ as shown in FIG. 2.

An alternative construction of said bracket A shown in FIG. 2, should a press not be available, is by separately cutting and welding the base $A_1$ and two sides $A_2$ to construct the "U" shaped bracket A including base $A_1$ and two sides $A_2$.

Figure 4:
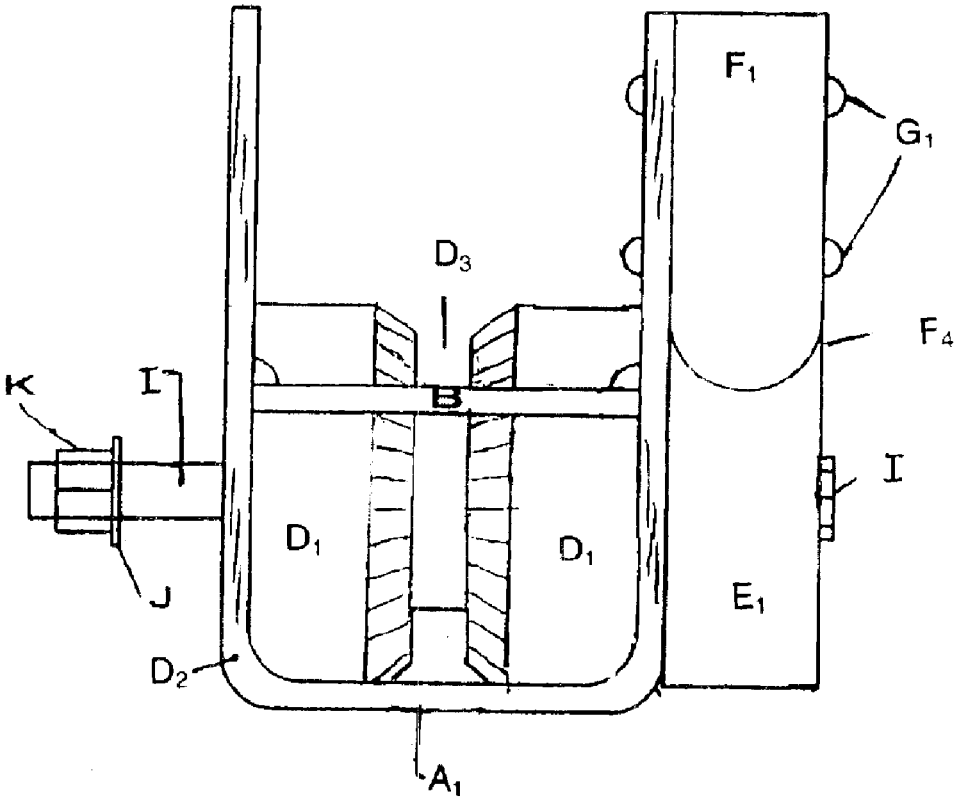
FIG. 4 is a rear view of an anchor assist device including the bracket shown in FIG. 2, showing horizontal and vertical guides for one side, but omitting horizontal and vertical guides on the other side to show detail of the bolt, washer, and a lock nut used for the center roller spindle.
Figure 6:
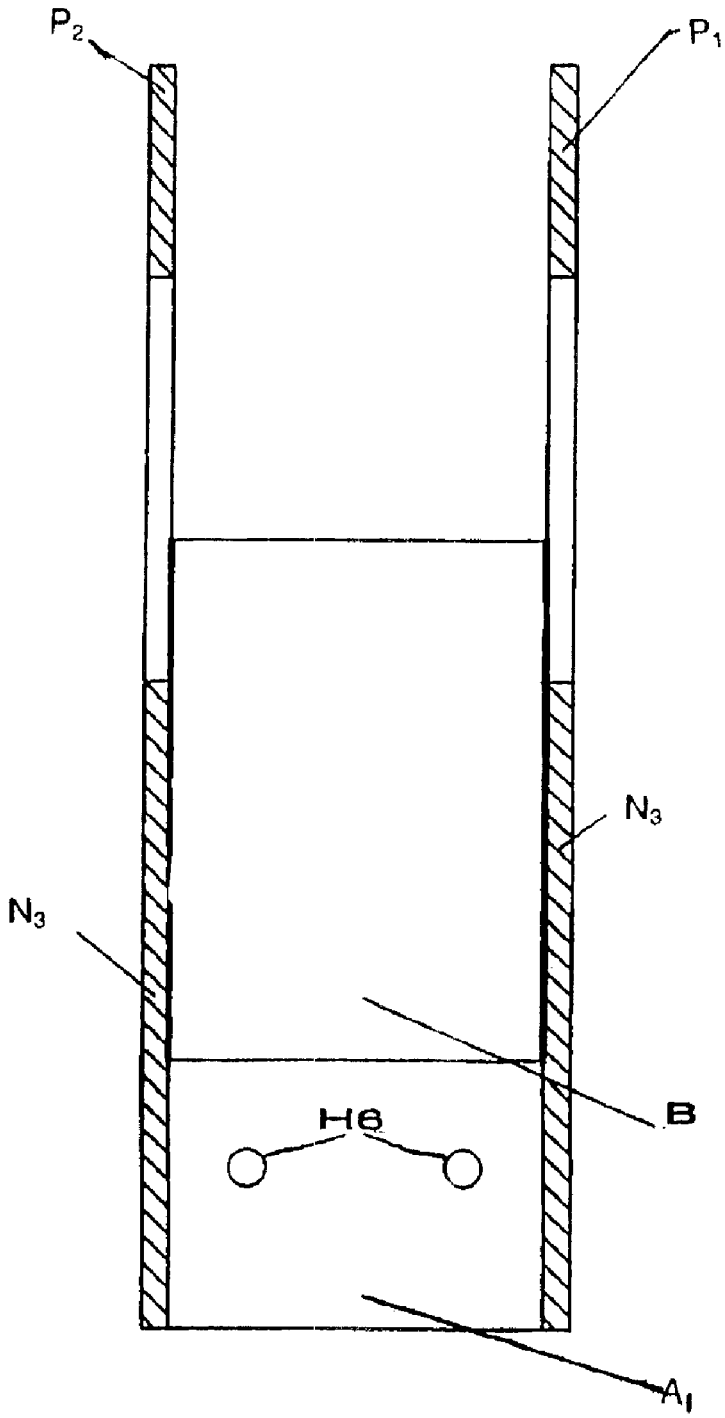
FIG. 6 is a top view of the bracket with the gusset plate shown welded in place in relation to the bottom base.

With either construction of bracket A, the gusset plate B is placed as shown in FIG. 4 and FIG. 6, and a clamp (not shown) is used to draw both sides $A_2$ tight to gusset B. Gusset B is held in place while being welded to sides $A_2$ by placing a 2½ inch spacer (not shown) between the base $A_1$ and gusset B.

Figure 5:
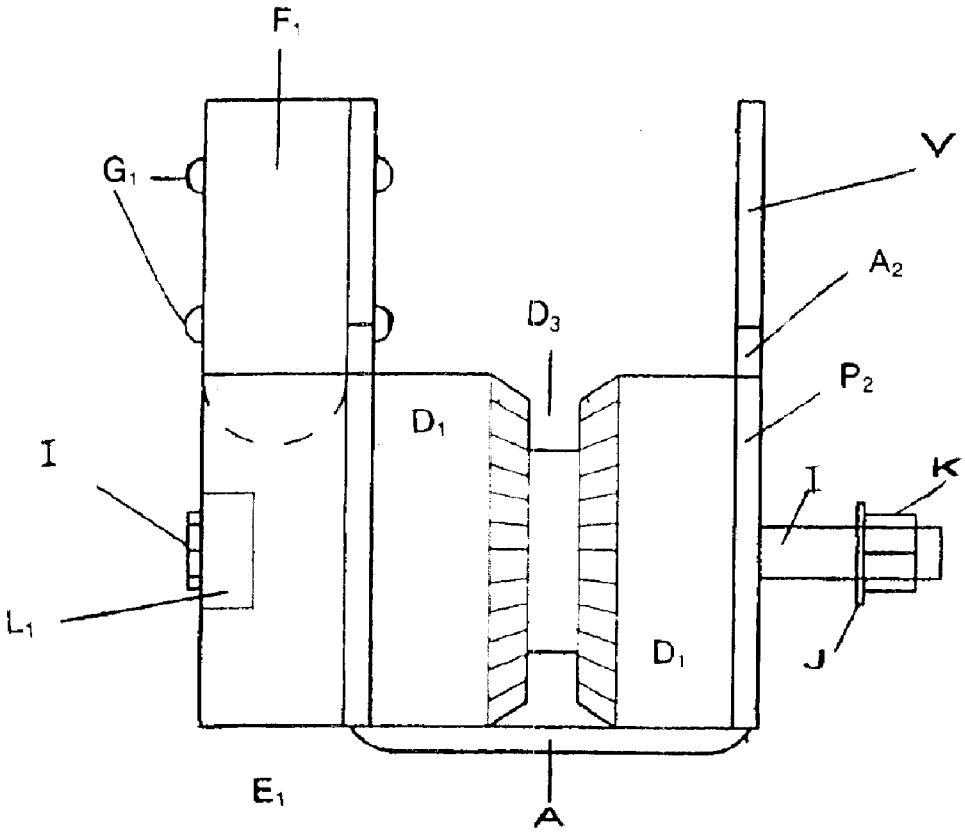
FIG. 5 is a front view of the bracket showing horizontal and vertical guides for one side, but omitting horizontal and vertical guides on the other side.
Figure 7:
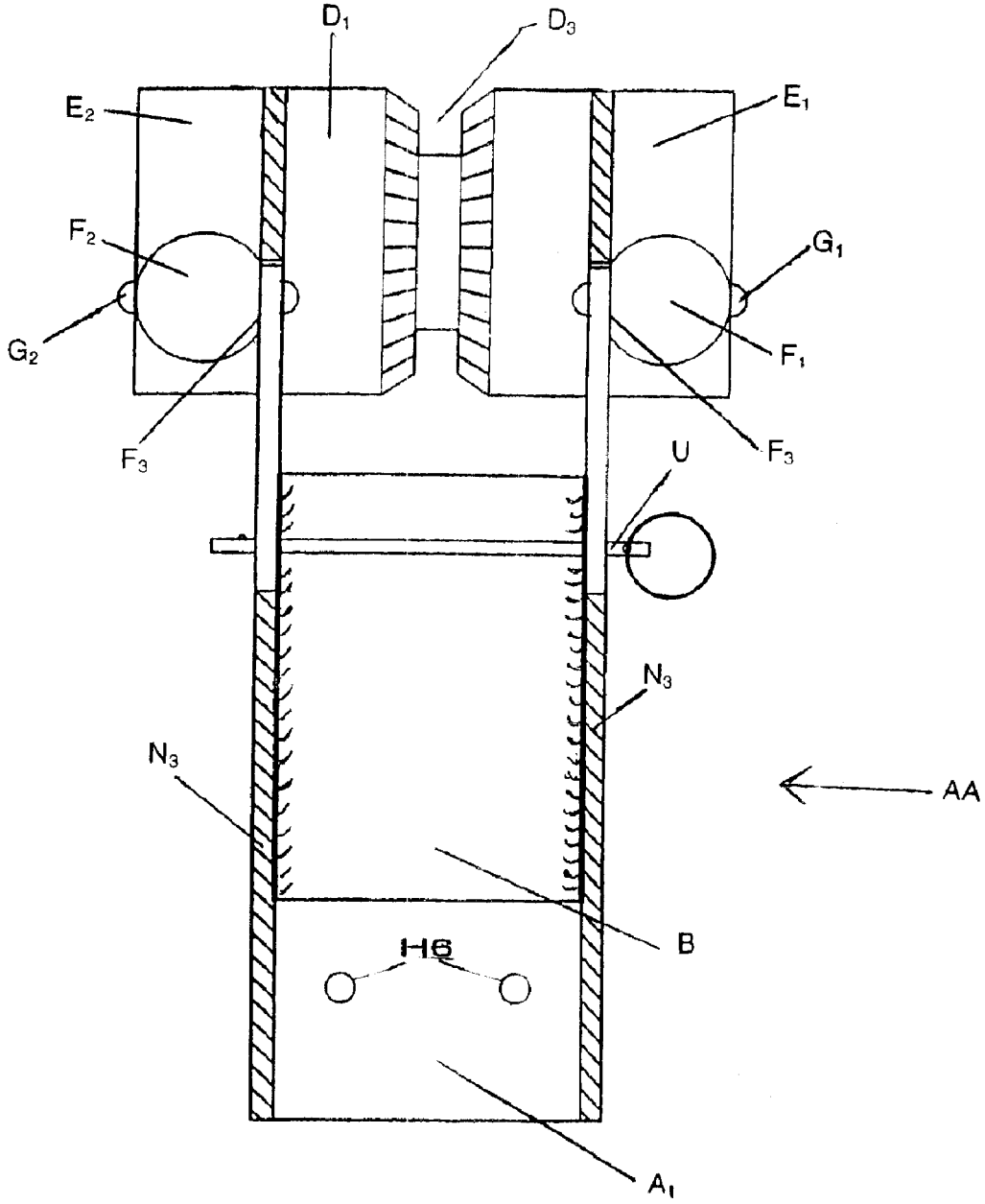
FIG. 7 is a top view of the anchor assist device shown in FIG. 4, showing the center roller guide and all of the outer horizontal and vertical guides.
Figure 8A:
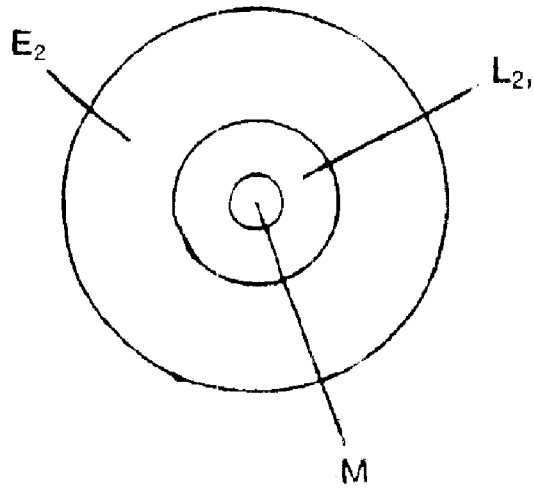
FIG. 8*a* is a side view of one of the horizontal guides and FIG. 8*b* is a side view of the center roller.
Figure 8B:
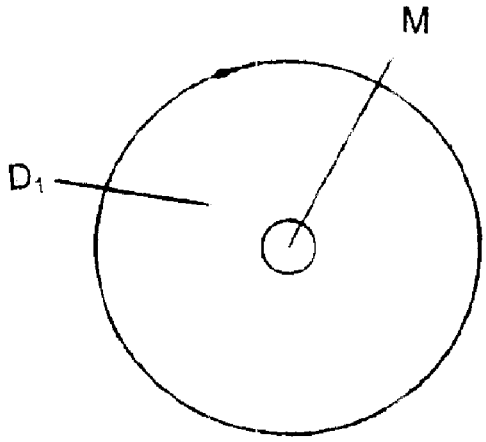

A piece of 3½ inch diameter UHMW plastic cylinder is cut to lengths for one tapered center roller $D_1$ and two horizontal guides $E_1$ and $E_2$ as shown in FIG. 4, FIG. 5, and FIG. 7. The center roller $D_1$ and two horizontal roller guides $E_1$ and $E_2$ are drilled centrally with a spindle hole M as shown in FIG. 8. The center roller $D_1$ is placed on a lathe and turned to the shape shown in FIG. 5, forming a center groove or radius $D_5$. Horizontal roller guides $E_1$ and $E_2$ are drilled with a countersunk hole $L_1$ or $L_2$ as shown in FIG. 5 and FIG. 8*a*.

Bolt I is fitted with one washer J and inserted through horizontal roller guide $E_1$ such that bolt I fits into countersunk hole $L_1$ and $L_2$. Bolt I is then placed through first hole $H_1$, then through center roller $D_1$, via spindle hole M, and then through a second hole $H_1$.

Horizontal roller guide $E_2$ is placed on bolt I followed by one washer J and lock nut K as shown in: FIG. 4. Bolt I and lock nut K are tightened until secured, but leaving center roller $D_1$ able to turn freely between roller supports $P_3$ and $P_4$ on sides $A_2$.

Figure 9:
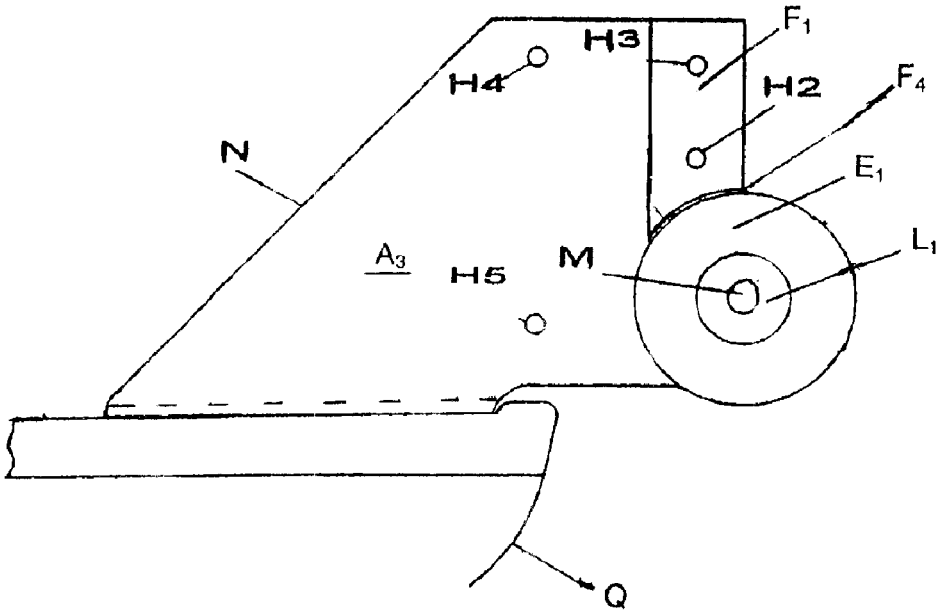
FIG. 9 is a side view of the anchor assist device as installed on the bow of a boat.

FIG. 7 and FIG. 4 show the length and diameters of vertical guides $F_1$ and $F_2$. Utilizing a planer, table saw or similar method, ⅛ inch of material is removed to form a flat mount surface $F_3$ on each of the vertical guides $F_1$ and $F_2$. A 1-¾ inch radius cut $F_4$ is made horizontally and perpendicular to the flat surface $F_3$ in each of the vertical guides $F_1$ and $F_2$. Vertical guides $F_1$ and $F_2$ are opposite mirror images of each other. The radius cut $F_4$ is aligned so that it closely matches the curvature of horizontal roller guides $E_1$ and $E_2$ on each side $A_2$ as shown in FIG. 4 and FIG. 9.

The vertical guides $F_1$ and $F_2$ are secured to bracket A by screws $G_1$ and $G_2$ inserted through bracket A at bottom hole $H_2$ and a top hole $H_3$, through either vertical guide $F_1$ and $F_2$ and secured to exterior faces $A_3$ of the side $A_2$ as shown in FIG. 7.

Cotter-less carriage pin U is placed in carriage pin hole $H_4$ as shown in FIG. 7, to secure an anchor (not shown). Cotter-less carriage pin U is placed in bottom storage hole $H_5$ as shown in FIG. 3, while the anchor is in use or ready for release. The device in this embodiment is ready to install on boat.

Figure 11:
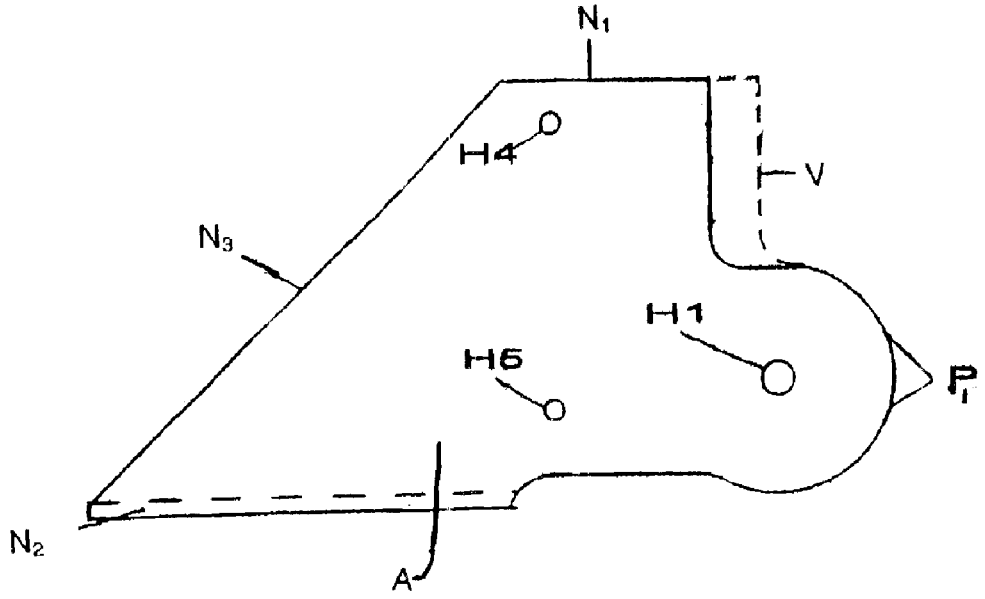
FIG. 11 is a side view of the bracket shown in FIG. 10, showing the bracket modification required for installation of the vertical guide roller.
Figure 12B:
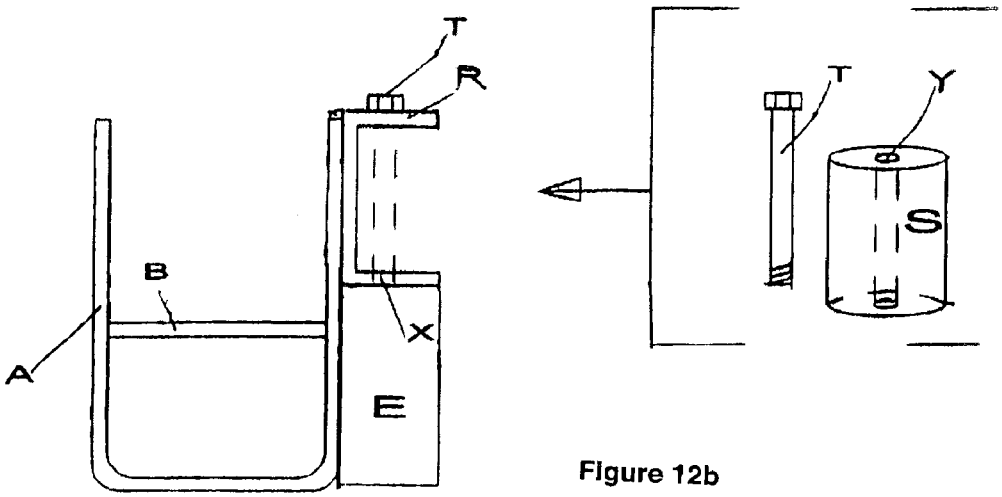
FIG. 12*a* is a side view and FIG. 12*b* is an exploded rear view of an alternative vertical guide roller bracket.
Figure 12A:
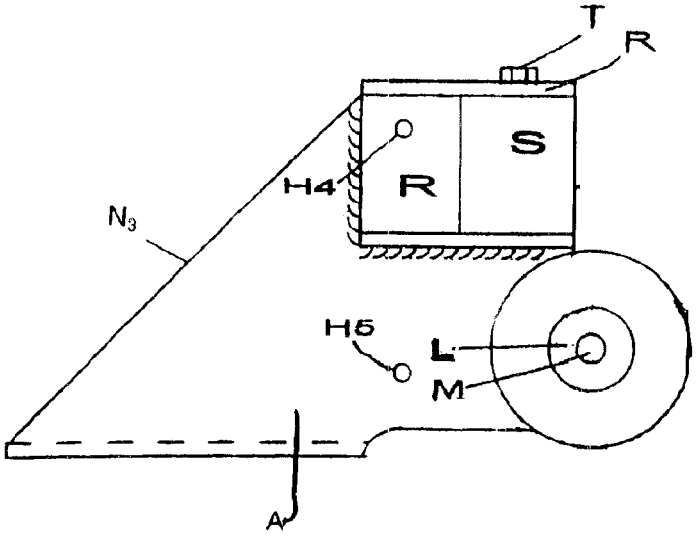
Figure 13:
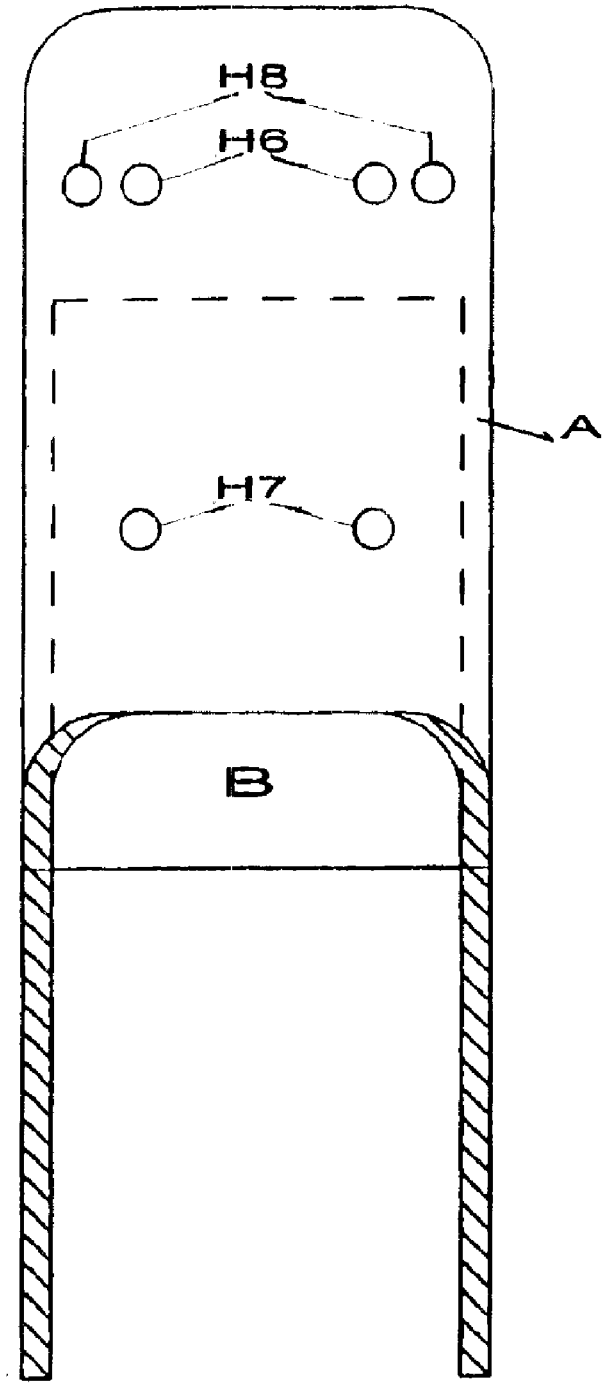
FIG. 13 is a bottom view of the bracket portion of the anchor assist device, showing mounting holes and optional hole location for the most common boat applications.
Figure 14:
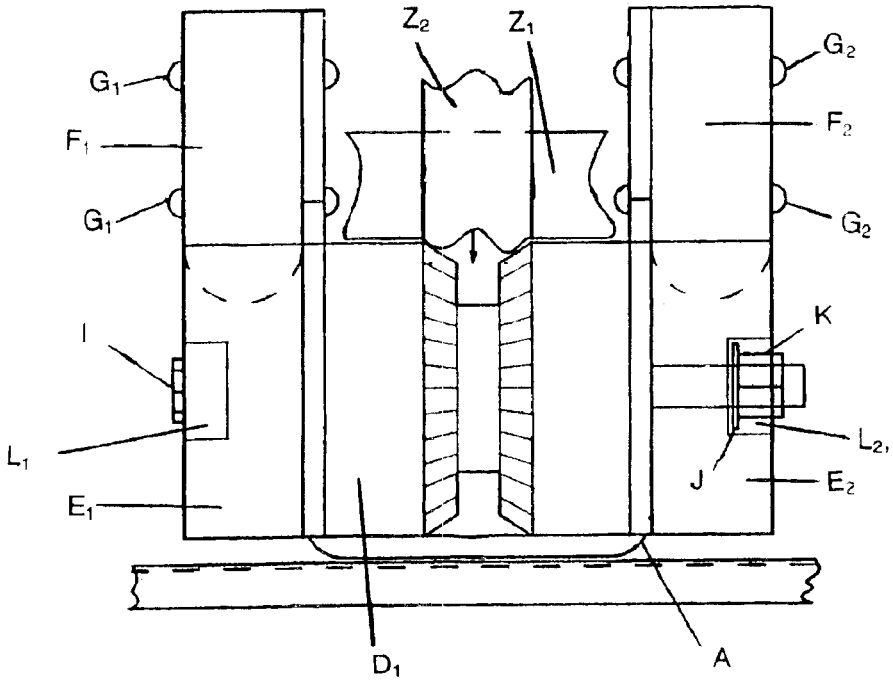
FIG. 14 is a front elevational view of the fully assembled anchor assist device shown in FIG. 4 and the elevation of the roller, guide and frame in relation to the boat bow deck.
Figure 15:
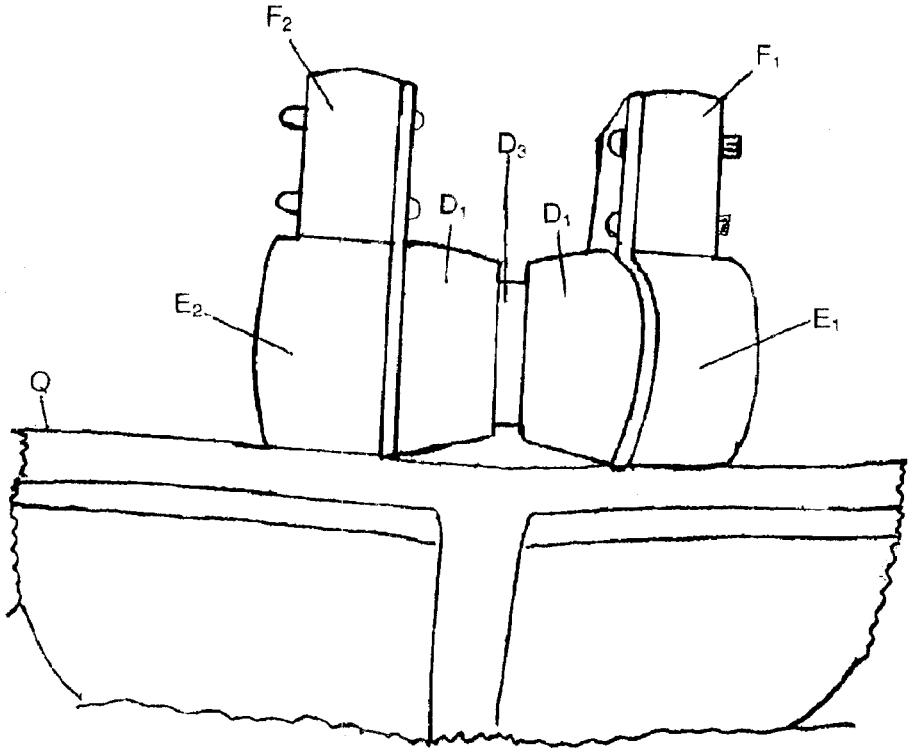
FIG. 15 is a front view of the device mounted on a boat.
Figure 16:
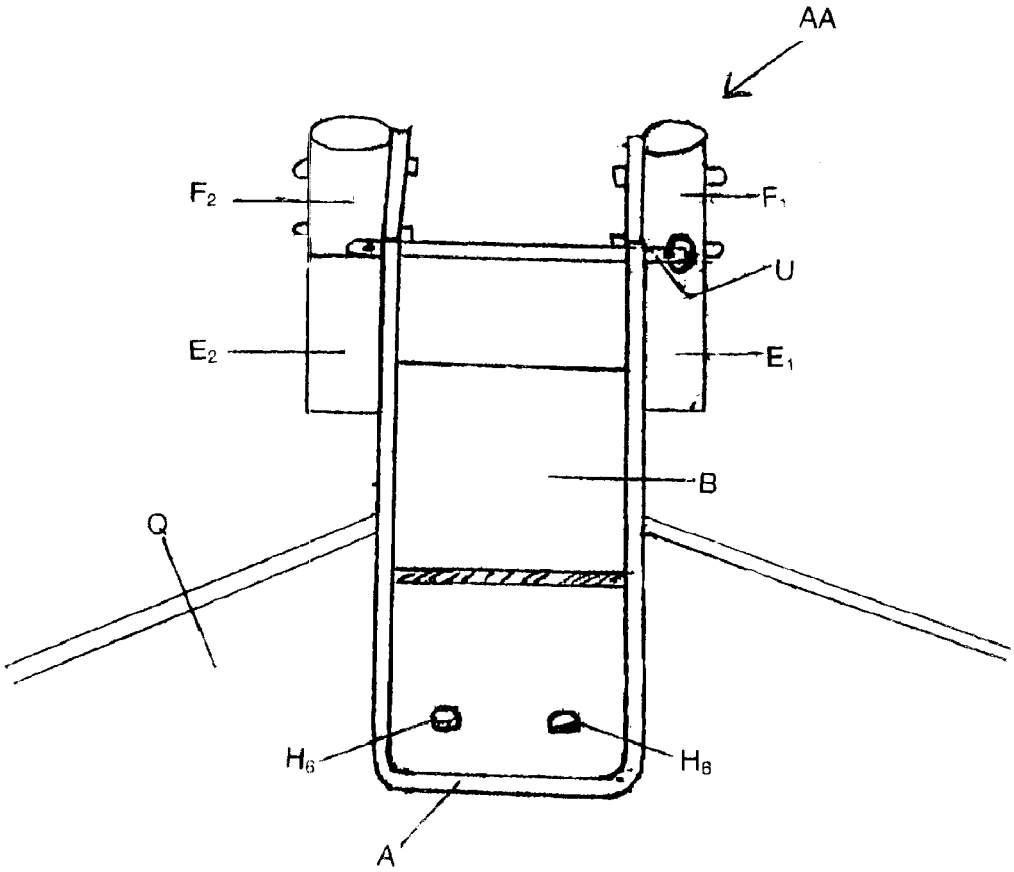
FIG. 16 is a top view of the device, with the center roller omitted to show the position of the device as mounted on a boat.

In an alternate embodiment known as the Deluxe version, the vertical guides $F_1$ and $F_2$ are omitted. Bracket A is modified according to the cut out V as shown in FIG. 11. A support R is a 4¾" long piece of 1¾×3 aluminum channel cut as shown in top plan view in FIG. 10. A threaded hole X is drilled in each flange of the support R and is tapped in the bottom flange with threads appropriate for roller spindle T. The center hole Y is cut as shown in FIG. 12, so that center hole Y is drilled in front upper vertical roller guide S to match hole X, allowing enough clearance for the roller S to rotate on spindle T. FIG. 12 shows the relationship between the roller guide S and horizontal guides $E_1$ and $E_2$. The support R is welded to bracket A as shown in FIG. 10 and FIG. 12. Carriage pin hole $H_4$ in bracket A is drilled through support R, as well as the underlying sides $A_2$. Roller guide S is placed in support R. Roller spindle T is inserted through support R and roller guide S and into threaded hole X.

Either embodiment of the anchor assist device AA is installed on a user's boat by means of fasteners $H_6H_7$, and $H_8$ shown as 5/16×1 inch, 24 thread stainless steel hex head bolts or pan head Philips screws with washers and lock nuts. The fasteners $H_6$ should be as far forward on the bow deck Q as possible while retaining full contact between the base $A_1$ and the bow deck Q. The anchor assist device AA is designed to support the center roller $D_1$ at a position beyond the bow Q, as shown, for example, in FIG. 9.

The resulting anchor assist device AA is designed to have a wide enough throat space, with 3½ inches, the length of the center roller $D_1$, between the sides $A_2$ to accommodate the various buoy puller mechanisms such as, but not limited to, EZ Marine lifter, Ironwood Pacific puller, or other similar pullers allowing retrieval and release of an anchor without removal of an anchor rope (not shown) from the anchor assist device AA in the bow chock position.

In use of the anchor assist AA, an anchor will be placed on the device, with anchor tines $Z_1$ extended slightly past the bow of the boat, so the anchor rests on gusset B and center roller $D_1$. The user will ready the rope release of an anchor retrieval system or prepare the anchor rope for release, and approach the anchor drop area. The user will lift the rope and tip the anchor, feeding rope while allowing the anchor to drop to bottom. Upon releasing adequate rope for safe anchoring, the user will tie or cleat off rope. The rope remains through the "U" shaped bracket in the device, positioned between the vertical side guides $F_1$ and $F_2$ and over the roller guide $D_1$, resting in the groove $D_3$.

For safest retrieval of the anchor, the user will secure the anchor rope then move the boat safely upstream avoiding the anchor rope and retrieval buoy. The anchor rope will remain in the "U" shaped bracket, ready for rope retrieval. Upon confirming that the anchor has been retrieved by buoy and the boat is clear of downstream obstructions and boats, the user will untie the anchor rope and then retrieve the anchor rope by pulling. The rope remains in "U" shaped bracket A, between the vertical guides $F_1$ and $F_2$. Easiest retrieval is achieved if the boat is positioned with the bow pointing toward the buoy to take advantage of the center roller $D_1$.

Upon reaching the retrieval buoy mechanism, firmly pulling the anchor rope will cause the retrieval mechanism, buoy, anchor lead chain (if used), and the anchor to roll up over the center roller $D_1$ and the anchor will settle into the storage and ready position, resting on the center roller $D_1$ for either another anchor drop, or anchor securement with the cotter-less retainment pin U.

With anchor systems, not utilizing a buoy retrieval system, the user will simply retrieve the anchor rope, allowing it to be supported by the center roller $D_1$, as the boat slowly advances forward. When the anchor is lifted from bottom and pulled to surface, the user will continue pulling the on rope firmly and the anchor will roll over the center roller $D_1$ and rest in its ready position.

In another exemplary embodiment of this device, the two sides $A_2$ are sloped from bottom to top at 45 degrees from the rear of the bracket A towards the front $D_2$ until an elevation of 6½ inches is reached. At the front $D_2$ there is a vertical surface extending to a roller position. The vertical surface is the framework for the upper guides $F_1$ and $F_2$ or rollers S that keep the rope in the guide and positioned over the center roller $D_1$ during all phases of use. From the roller position the frame work takes a circular radius toward the front and continues around until it achieves a position slightly higher than the baseplate.

Sides $A_2$ are affixed to the base $A_1$ at 90 degree angles resulting in a "U" shaped bracket that is approximately one and ½ times higher than wide. The minimum inside width between the sides $A_2$ is 3½ inches and may be made wider to accommodate deluxe versions of the device that include vertical rollers S instead of fixed guides $F_1$ and $F_2$ on the front uprights of the device AA.

A gusset plate B will be the same length as the base plate A and will be welded into position to form the platform of the anchor rest and to increase bracket strength and uniformity.

The center roller $D_1$ is approximately equal in length to the inside width of the bracket A. The center roller $D_1$ has a centered ¾ inch deep rope guide configuration, tapered at the beginning, ending with a vertical groove equal in width to the intended rope diameter to be used.

The horizontal roller guides $E_1$ and $E_2$ and center roller $D_1$ are secured in place with a fastener assembly including a ½ stainless steel hex bolt, washers, and a lock nut. The fastener assembly is drawn to a tightness which allows the center roller to freely rotate on its axis center radius $D_2$. The horizontal guides $E_1$ and $E_2$ act primarily as abrasion protectors to prevent the anchor rope from contacting the metal framework during anchor operations and use, but can be modified to roll by adjusting the fastener assembly.

In one embodiment, vertical guides $F_1$ and $F_2$ are made of 1½ cylinder of UHMW polyethylene or similar material, with a ⅛ inch of the material removed to form a flat mounting surface $F_3$ on each guide $F_1$ and $F_2$. The vertical guides $F_1$ and $F_2$ are installed above the center of the center roller $D_1$ on the exterior vertical face $A_3$ of the bracket A by means of screws $G_1$ and $G_2$, which may be left exposed to assist in keeping an anchor rope on the guide during the pulling process in the event the boat position on the water surface changes significantly. There is a radius cut $F_4$ in the vertical guides $F_1$ and $F_2$ that matches the radius of the respective horizontal roller guide $E_1$ or $E_2$ immediately below it. The radius cut $F_4$ prevents pinching of the anchor rope during the pulling process.

The details in the above description illustrate some preferred embodiments and should not be construed as a limitation on the scope of the invention. The completed device, either version, is of unique design and as described in the detailed description is unique in the ability to store the anchor, drop the anchor, and retrieve the anchor with retrieval mechanisms without requiring the removal of the rope. These features, designed to work with the retrieval mechanisms, also allow the device to function well as a bow chock or guide for an un-buoyed anchor line and anchor.

We claim:

1. A device for guiding an anchor rope, comprising:

(a) a mounting bracket having a base and a pair of sides spaced apart from each other and defining a channel;

(b) a center roller for guiding the anchor rope, extending between said sides and disposed rotatably about a horizontal center roller axis extending between said sides at a location adjacent a front of said channel;

(c) a pair of non-abrasive vertical guides each located adjacent and extending along a front portion of a respective one of said sides to aid in guiding an anchor rope; and (d) at least one of said non-abrasive vertical guides including a vertical roller mounted to rotate about a vertical axis of rotation.

2. The device of claim 1, further comprising a gusset located a distance above said base, supporting said sides and positioned to support a shank of an anchor in a ready position.

3. The device of claim 1, where said device further comprises an anchor locking pin extending horizontally through and between said sides at a location inboard from the vertical guides.

4. The device of claim 1, where said vertical guides extend vertically above said pair of sides but do not prevent upward removal of said anchor rope.

5. The device of claim 1, wherein said center roller is made from ultra high molecular weight plastic.

6. The device of claim 1, wherein said pair of vertical guides are made from ultra high molecular weight plastic.

7. A device for guiding an anchor rope, comprising:

(a) a mounting bracket having a base and a pair of sides spaced apart from each other and defining a channel;

(b) a center roller for guiding the anchor rope, extending between said sides and disposed rotatably about a horizontal center roller axis extending between said sides at a location adjacent a front of said channel;

(c) a pair of non-abrasive vertical guides each located adjacent and extending along a front portion of a respective one of said sides to aid in guiding an anchor rope; and (d) a pair of horizontal roller guides each located adjacent a respective one of said sides of said mounting bracket and disposed rotatably about a respective horizontal axis.

8. The device of claim 7, further comprising a gusset located a distance above said base, supporting said sides and positioned to support a shank of an anchor in a ready position.

9. The device of claim 7, where said device further comprises an anchor locking pin extending horizontally through and between said sides at a location inboard from the vertical guides.

10. The device of claim 7, where said vertical guides extend vertically above said pair of sides but do not prevent upward removal of said anchor rope.

11. The device of claim 7, wherein said center roller is made from ultra high molecular weight plastic.

12. The device of claim 7, wherein said pair of vertical guides are made from ultra high molecular weight plastic.

13. A device for the guiding of an anchor rope, comprising (a) a mounting bracket having a base and a pair of sides spaced apart from each other, each of said sides having a sloping rear margin, and said base and pair of sides defining a channel;

(b) a ultra high molecular weight (UHMW) polyethylene center roller for guiding an anchor rope, extending between said sides, and disposed rotatably about a horizontal roller axis extending between said sides at a location adjacent a front position of said channel, and defining a rope guide groove;

(c) a pair of non-abrasive vertical guides adjacent and extending along a front portion of said sides to aid in guiding the anchor rope, said vertical guides including a pair of vertical rollers each mounted to rotate about a respective vertical axis of rotation, each of said vertical guides extending vertically above said pair of sides without preventing upward removal of said anchor rope; and (d) a pair of horizontal roller guides each located adjacent a respective one of said sides of said mounting bracket and disposed rotatably about said horizontal roller axis.

14. The device of claim 13, further comprising a gusset located a distance above said base, supporting said sides and positioned to support a shank of an anchor in a ready position.

15. The device of claim 13, further comprising an anchor locking pin extending horizontally through and between said sides at a location inboard from the vertical guides.

* * * * *